US010107095B2

(12) United States Patent
Christian et al.

(10) Patent No.: US 10,107,095 B2
(45) Date of Patent: Oct. 23, 2018

(54) APPARATUS AND METHOD FOR MONITORING A FLUID

(71) Applicant: Weatherford Technology Holdings, LLC, Houston, TX (US)

(72) Inventors: Sean M. Christian, Sparrows Point, MD (US); Daniel Charles Boyde, Cornwall (GB)

(73) Assignee: Weatherford Technology Holdings, LLC, Houston, TX (US)

( * ) Notice: Subject to any disclaimer, the term of this patent is extended or adjusted under 35 U.S.C. 154(b) by 648 days.

(21) Appl. No.: 14/517,622

(22) Filed: Oct. 17, 2014

(65) Prior Publication Data

US 2015/0130468 A1 May 14, 2015

Related U.S. Application Data

(60) Provisional application No. 61/892,306, filed on Oct. 17, 2013.

(51) Int. Cl.
*G01V 3/18* (2006.01)
*E21B 49/08* (2006.01)
*E21B 47/10* (2012.01)

(52) U.S. Cl.
CPC ..... *E21B 49/087* (2013.01); *E21B 47/1015* (2013.01)

(58) Field of Classification Search
CPC .. E21B 47/102; E21B 47/005; E21B 47/1015; E21B 47/02224; G01V 3/30
USPC ..... 324/324, 438, 325, 326, 323, 375
See application file for complete search history.

(56) References Cited

U.S. PATENT DOCUMENTS 2,938,702 A * 5/1960 Rosebrook ..... B23Q 35/36 251/248
4,032,779 A 6/1977 Arnold et al.
4,292,853 A * 10/1981 Williams ..... G01F 1/06 73/861.79
4,507,552 A * 3/1985 Roesner ..... E21B 47/1015 250/259

(Continued)

FOREIGN PATENT DOCUMENTS

DE 4230919 A1 3/1994
EP 2372331 A1 10/2011

(Continued)

OTHER PUBLICATIONS

PCT International Search Report and Written Opinion dated May 26, 2015, for International Application No. PCT/US2014/061184.

*Primary Examiner* — Tung X Nguyen
*Assistant Examiner* — Dominic Hawkins
(74) *Attorney, Agent, or Firm* — Patterson & Sheridan, L.L.P.

(57) ABSTRACT

A fluid monitoring apparatus includes a housing and a tracer sensor attached to an exterior of the housing. The housing has at least one flow passage for a fluid sample and a port for the tracer sensor to monitor the fluid sample in the housing. In one example, the monitoring apparatus may include a plurality of tracer sensors attached to the housing, wherein the tracer sensors are interchangeably attached to the housing. In one embodiment, the monitoring apparatus may be attached to a first well for detecting the presence of a tracer in the first well, wherein the tracer is supplied from a second well.

20 Claims, 8 Drawing Sheets

(56) References Cited

U.S. PATENT DOCUMENTS 4,558,219 A * 12/1985 LeBlanc ..... E21B 47/1015 250/259
4,958,684 A * 9/1990 Nguyen ..... E21B 43/24 166/252.6
5,077,471 A * 12/1991 Smith, Jr. ..... E21B 47/1015 250/259
5,531,112 A * 7/1996 Young ..... E21B 17/1021 166/117.7
6,276,217 B1 * 8/2001 Hirano ..... G01P 5/001 73/861.05
8,596,354 B2 * 12/2013 Hartshorne ..... E21B 47/1015 166/250.12
2003/0056952 A1 * 3/2003 Stegemeier ..... E21B 43/00 166/250.12
2003/0131991 A1 * 7/2003 Hartog ..... E21B 27/02 166/250.12
2003/0202895 A1 * 10/2003 Althouse ..... F01C 21/0809 418/2
2009/0059332 A1 * 3/2009 DiFoggio ..... G01N 21/0303 359/196.1
2010/0105292 A1 * 4/2010 Nagel ..... B24B 33/02 451/8
2010/0314105 A1 * 12/2010 Rose ..... E21B 43/26 166/250.1
2011/0036162 A1 * 2/2011 Holoch ..... G01F 1/6845 73/273
2011/0040484 A1 * 2/2011 Ramirez Sabag ..... E21B 44/00 702/8
2011/0239754 A1 * 10/2011 Dyer ..... E21B 43/08 73/152.18
2011/0277996 A1 * 11/2011 Cullick ..... E21B 33/138 166/250.12
2013/0333891 A1 * 12/2013 Fripp ..... E21B 29/02 166/302

FOREIGN PATENT DOCUMENTS

WO 0165053 A1 9/2001
WO 2013071189 A1 5/2013

* cited by examiner

APPARATUS AND METHOD FOR MONITORING A FLUID

BACKGROUND OF THE INVENTION

Field of the Invention

Embodiments of the present invention generally relate to apparatus and methods for monitoring a fluid. Particularly, embodiments of the invention relate to monitoring a fluid for the presence of a tracer.

Description of the Related Art

Optimal oil production from the reservoir depends upon reliable knowledge of the reservoir characteristics. Traditional methods for reservoir monitoring include seismic log interpretation, well pressure testing, production fluid analysis, and production history matching. Due to the complexity of the reservoir, all information available is valuable in order to give the operator the best possible knowledge about the dynamics in the reservoir.

During enhanced oil recovery operations, the reservoir may be monitored to determine injection fluid breakthrough. For example, in a waterflooding operation, fluid samples in the wellbore may be collected and analyzed in a laboratory to determine water breakthrough in order to estimate reservoir characteristics. However, analysis in the laboratory only indicates an event such as injection fluid breakthrough has occurred and the temporal resolution is generally poor.

There is a need, therefore, for apparatus and methods of monitoring fluids in the wellbore in real time in order to remove this temporal uncertainty.

SUMMARY OF THE INVENTION

A fluid monitoring apparatus includes a housing and a tracer sensor attached to an exterior of the housing and sensing the interior. The housing has at least one flow passage for a fluid sample and a port for the tracer sensor to monitor the fluid sample in the housing. In one example, the monitoring apparatus may include a plurality of tracer sensors attached to the housing, wherein the tracer sensors are easily reconfigurable to sample a specific injection fluid scenario. In one example, a unique combination of sensors can be easily reconfigured to sample the reservoir.

In one embodiment, a method of monitoring a fluid from a reservoir includes providing a tracer sensor in fluid communication with a first monitoring well; injecting a fluid and a tracer from a second injection well into the reservoir; urging the fluid and the tracer from the reservoir into the first well; and monitoring the fluid in the first well using the tracer sensor to detect the tracer. In this embodiment, the tracer sensor is attached to a tubular housing that is coupled to a wellhead of the first well.

In a second embodiment, the injection well and the monitoring well may be the same well. For example, a multilateral completion may be monitored for injection fluid breakthrough from one lateral into a second lateral of the same wellbore.

In another embodiment, an apparatus for monitoring a fluid includes a housing having a bore therethrough; a port in the housing; and a tracer sensor attached to an exterior of the housing and to the port, wherein the tracer sensor is configured to monitor the fluid flowing in the bore for the presence of a tracer.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

In one embodiment, a fluid monitoring system may be used to monitor a fluid for the presence of a tracer. The system may be used to detect the tracer in real time. In one example, the system may be used to monitor the occurrence of a water breakthrough in a secondary hydrocarbon recovery system employing water injection. The water breakthrough may be indicated by detection of a tracer in a production well, i.e., the monitoring well, wherein the tracer originated from an injection well.

Figure 1:
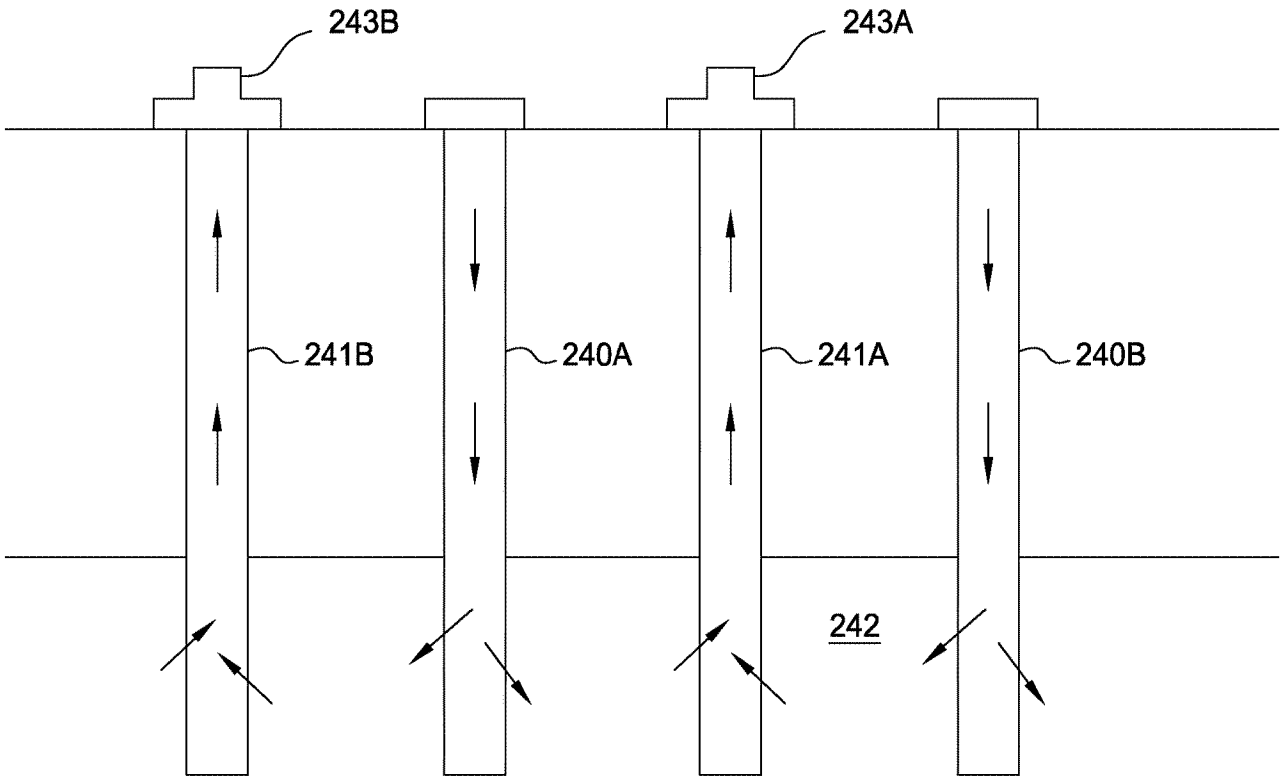
FIG. 1 shows a water flooding operation.

FIG. 1 illustrates a water injection system having at least one injection well 240A, B and at least one production well 241A, B. Water or other fluids such as gas or hydrocarbon are injected into the injection well 240A, B to increase the pressure in the reservoir 242 and to displace the hydrocarbon in the reservoir 242. The displaced hydrocarbon flows toward and is collected by the production well 241A, B. The displaced hydrocarbon then flows up the production well 241A toward the wellhead 243A.

In one embodiment, one or more tracers may be added to the fluid being injected into the reservoir 242. The tracers are injected into the reservoir 242 and flow toward the production well 241A where the tracers are collected and urged up the well 241A to the wellhead 243A. If multiple injection wells 240A, B are used, each well 240A, B may be provided with a different tracer to uniquely identify the well origin of the tracer. A tracer detector may be coupled to the production well 241A to detect the tracers injected into the reservoir 242. The tracers in the production well 241A may be monitored in real time to determine an event such as injection fluid breakthrough. The exact timing of this event may assist with characterization of the reservoir.

In one embodiment, tracer A may be added to the injection fluid in injection well 240A, and tracer B may be added to the injection fluid in injection well 240B. As the tracers make their way through the reservoir 242, the tracers may flow toward any of the production wells 241A, B. With reference to production well 241A, the tracers flow into and up the production well 241A, where they may be detected by the tracer detector. The detection of the particular tracer will indicate that fluid from the injection wells where the detected tracer originated has reached the production well 241A. For example, if tracer B is detected, then injection fluid from injection well 240B has reached production well 241A.

Figure 2:
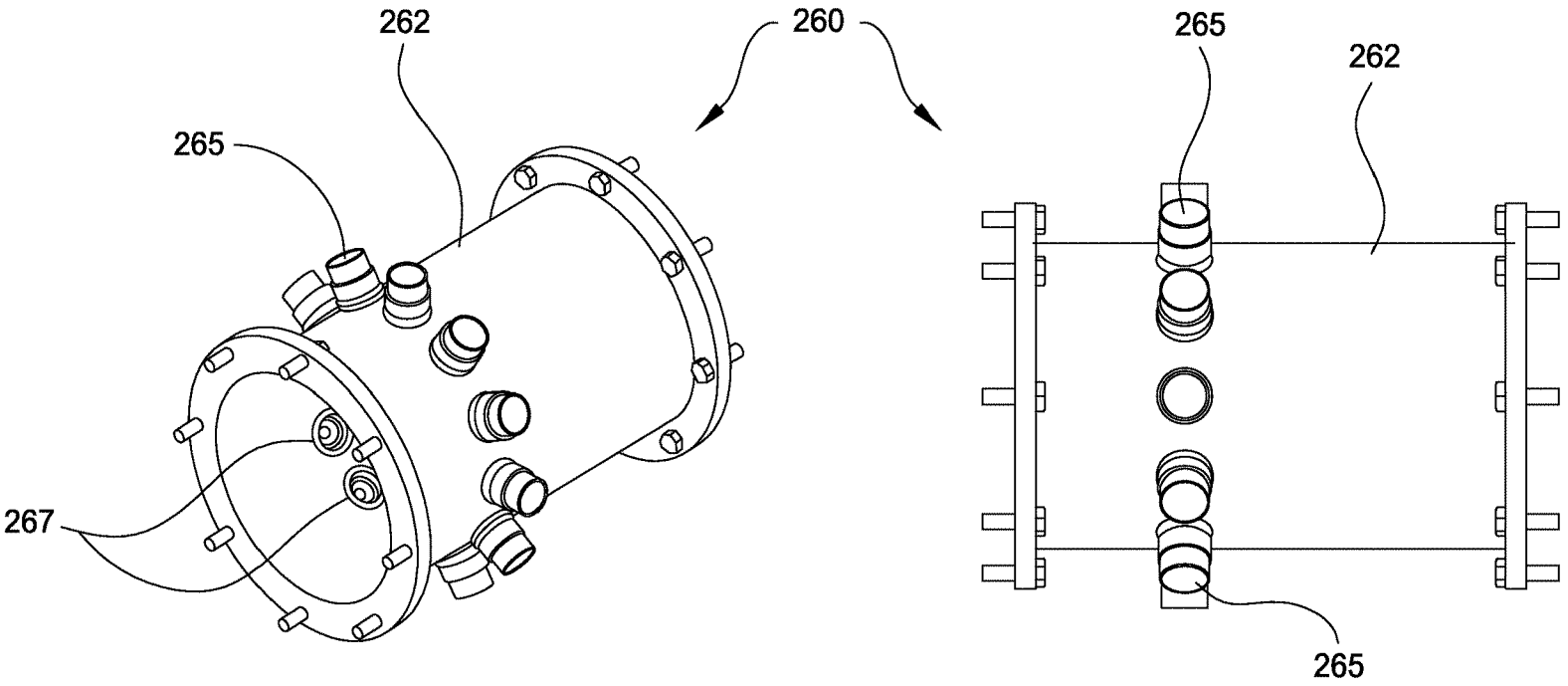
FIG. 2 are different views an exemplary embodiment of a tracer detector.

FIG. 2 illustrates an exemplary embodiment of a tracer detector 260. In one embodiment, the tracer detector 260 may include one or more tracer sensors 265 for detecting the tracers and a housing 262 for supporting the one or more sensors 265. As shown, the housing 262 is configured for connection with the wellhead 243A in the production well 241A. A plurality of tracer sensors 265 may be attached to the housing 262. Each of the tracer sensors 265 may be configured to detect the presence of a unique tracer as the tracer flows within the housing 262 past the sensor 265. It is contemplated that multiple tracer sensors 265 detecting the same unique tracer may be used to enhance detection of that unique tracer in the production well 241A. In one embodiment, the tracer sensor 265 may be configured to provide a physical, visual, and/or audio indication when the tracer is detected. For example, the tracer sensor 265 may "light up" when the tracer is detected. In another embodiment, the tracer sensor 265 may send a signal to a controller. The tracer sensor may transmit a signal via a wired or a wireless signal, or both. It is contemplated that the tracer detector 260 may be positioned at any suitable location where the tracer sensor 265 is in fluid communication with the fluid in the production well 241A. For example, the housing 262 may be positioned in the production well 241A at a location adjacent the reservoir 242. In another example, the housing 262 may be connected to a flow line leaving the wellhead 243A, a flow line entering a separator, or a flow line leaving the liquid outflow line of the separator.

In one embodiment, the tracer sensors 265 may be modular components of the tracer detector 260. In this respect, a tracer sensor 265 may be quickly replaced by another tracer sensor 265 to detect the same or different tracer. For example, a tracer sensor 265 configured to detect tracer A may be detached and replaced with a tracer sensor 265 configured to detect tracer C using a modular connection. Exemplary modular connections include a threaded connection, and any other suitable modular connection. As shown in FIG. 2, the tracer sensors 265 are threadedly connected to ports 267 in the housing 262. The tracer sensors 265 may be replaced by removing the existing tracer sensor 265 and threading another tracer sensor 265 to the open port 267 in the housing 262. In this respect, the tracer detector 260 may be rapidly reconfigured to detect one or more unique combination of tracers. During the exchange, fluid flow in the production well 241A may be stopped or diverted from the tracer sensors 265. The tracer sensors 265 may be arranged circumferentially in a ring pattern, as shown, or a multiple ring pattern. In another embodiment, the tracer sensors 265 may be arranged in a spiral pattern around the exterior of the housing 262 or a combination of ring and spiral pattern. It is contemplated that the tracer sensors 265 may be positioned in any suitable arrangement to facilitate detection of the tracers.

In yet another embodiment, the housing 262 for the tracer detector 260 may include one or more vanes for directing the fluid flow in the housing 262. For example, the vanes may be attached to the interior of the housing 262 and configured to direct the fluid to flow in a spiral pattern through the housing 262. In this respect, the fluid may flow closer to the ports 267 in the housing 262, thereby facilitating detection by the sensors 265. In another embodiment, the tracer sensors 265 may be arranged in a spiral pattern that corresponds to the flow path of the fluid to maximize detection of the tracers.

In yet another embodiment, the housing 262 for the tracer detector 260 may include one or more fluid bypass for directing a portion of the fluid around the housing 262 or other sections of the wellhead. For example, a bypass passage may direct fluid out from a lower portion of the housing and then allow the fluid to re-enter the housing at an upper portion of the housing. In this example, one or more sensors 265 may be placed in the bypass passage to detect for the tracers flowing through the bypass passage.

Figure 2A:
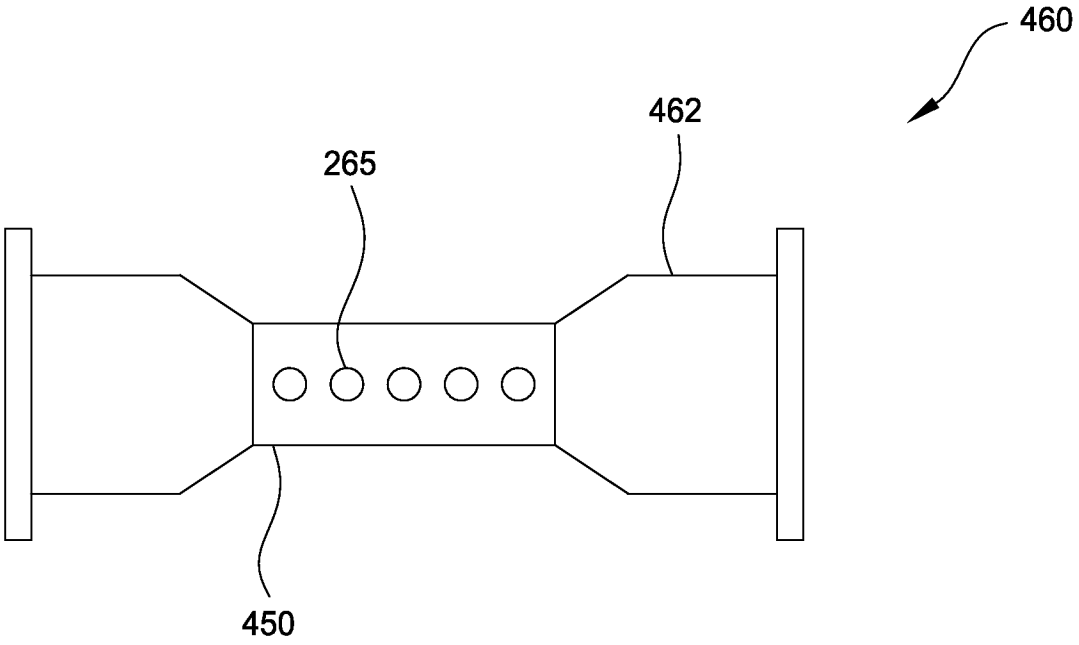
FIG. 2A shows another exemplary embodiment of a tracer detector.

In another embodiment, the housing 462 for the tracer detector 460 may include a thinner profile 450 as shown in FIG. 2A. An exemplary thinner profile 450 may have a thickness that is smaller than the diameter of the housing 462. The width of the profile 450 is a size sufficient to allow the flow volume to remain constant. In one embodiment, the cross-sectional area of the thinner profile 450 is about the same size as the cross-sectional area of the regular profile portions of the housing 462. In another embodiment, the cross-sectional area of the profile 450 is within 5%, within 10%, or within 25% of the cross-sectional area of the regular profile portions of the housing 462. In one example, the profile 450 has a thickness that is between 40% and 92%, between 70% and 90%, or between 75% and 90% of the inner diameter of the housing 462. As shown in FIG. 2A, two opposing sides of the profile 450 are flat. One or more tracer sensors 265 may be positioned along the flat sides of the reduced profile 450, which brings the tracer sensors 265 closer in proximity to the tracers flowing through the housing 462.

Figure 3:
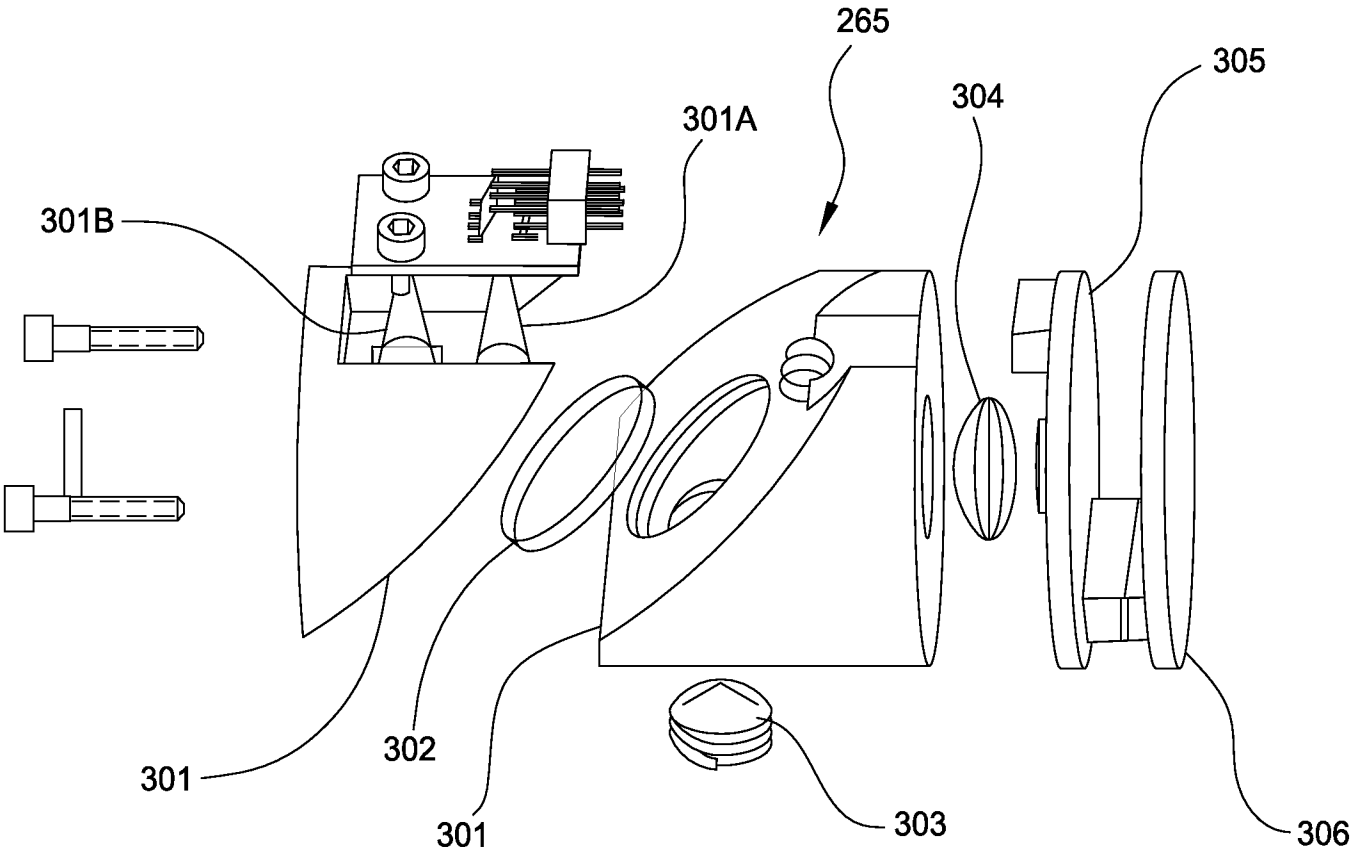
FIG. 3 shows an exemplary embodiment of a tracer sensor.

In one embodiment, the tracer sensor 265 may be configured to detect any suitable type of tracers as discussed herein. Exemplary tracer sensors include optical sensors, radiometric sensors, chemical sensors, magnetic sensors, particle size sensors, and any suitable sensor known to a person of ordinary skill in the art. For example, the tracer sensor may be a fluorimeter or a phase based measurement device. Other exemplary tracer sensors include spectrophotometers, spectrometers, spectrofluorometers, refractive index analyzers, and similar devices configured to measure a fluid's spectral response. Each of these devices may use electromagnetic (EM) radiation to monitor the fluid for the tracer. In general, the wavelengths of the EM radiation can be in the x-ray, gamma, ultraviolet, visible, infrared or any combination of these ranges. FIG. 3 illustrates a suitable optical sensor configured to detect a tracer. The sensor 265 may include an optical housing 301 and a reference beam 301A and a sensory beam 302B. The beams may be directed through a dichroic filter 302 and a focusing optic 304. A beam trap 303 may be provided between the filter 302 and the optic 304. The sensor 265 may further include an EM sensor 305 and a central processing unit and communication module 306. In another embodiment, the tracer sensor 265 may be a radioactive tracer sensor configured to detect high-energy particles.

Figure 3A:
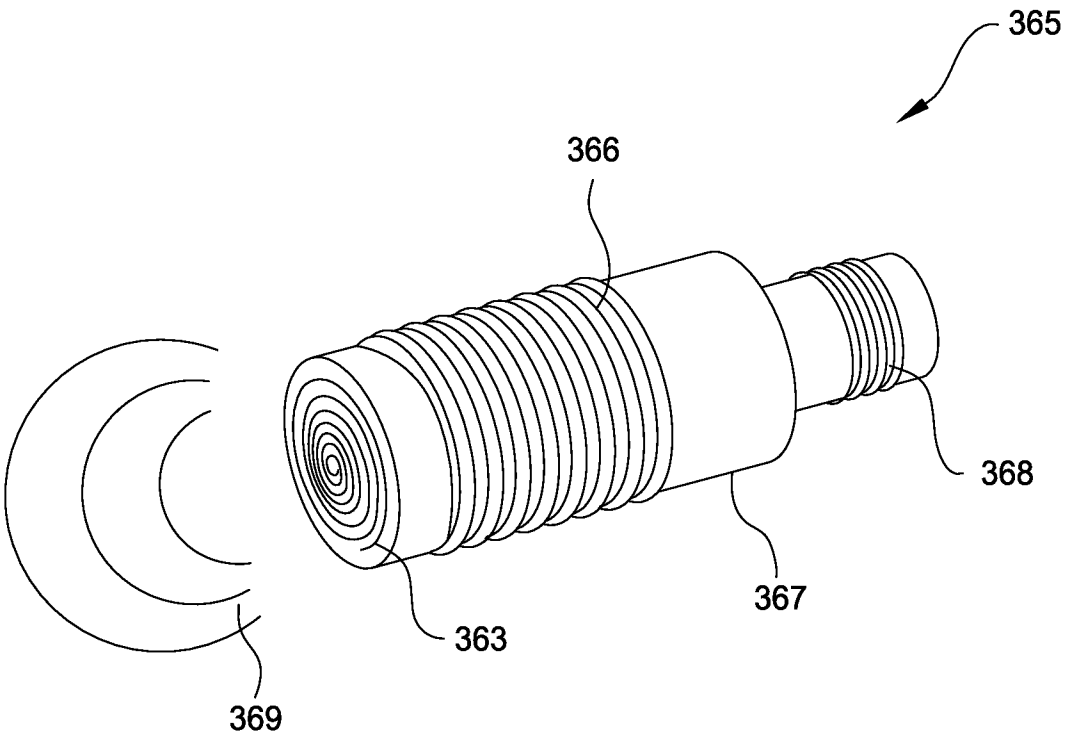
FIG. 3A shows another exemplary embodiment of a tracer sensor.

In another embodiment, the tracer sensor 265 may be an inductive sensor 365 as shown in FIG. 3A. The inductive sensor 365 may include an induction loop 363 whose inductance changes when a metallic tracer is located in proximity to the sensing field 369 of the inductive sensor 365. The induction loop 363 may be disposed on the front end of the body 367. The threads 366 wrapped around the transducer body 367 at one end may be used for flush mounting in the housing such as housing 262, 462, 562. In this respect, one or more inductive sensors 365 may be threadedly connected to ports 267 in the housing 262. A threaded section 368 at the other end may be used for electrical connection such as to an electrical source.

Figure 3B:
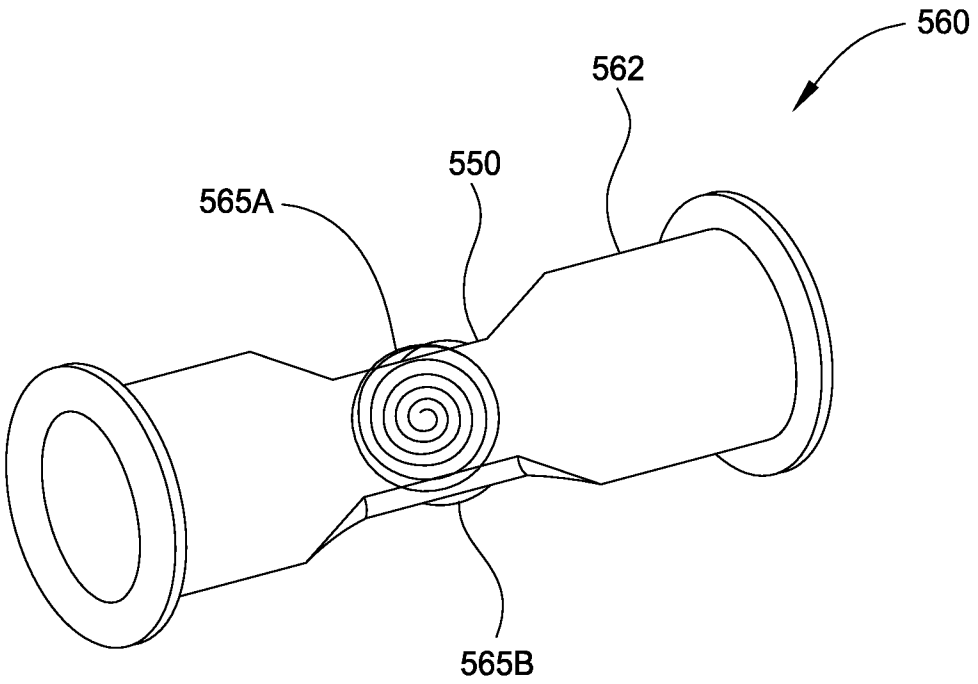
FIG. 3B shows another exemplary embodiment of a tracer detector.

FIG. 3B illustrates another embodiment of a tracer detector 560. The tracer detector 560 includes two tracer sensors 565A, 565B disposed on a flat section on each side of the housing 562. In the embodiment, the tracer sensors 565A, 565B are disposed on flat sections of a reduced profile 550 of the housing 562. The tracer sensors 565A, 565B may be a type of inductive sensors having a flat coil. In one embodiment, the reduced profile 550 may be made of a non-paramagnetic material. The sensing field formed between the two tracer sensors 565A, 565B will detect the tracers when they flow through the reduced profile 550 of the housing 562.

The tracers may be any suitable material that can travel in the wells 240A, B and 241A, B and the reservoir 242 without being consumed, and therefore, detected at another location. Additionally, the tracers may be chemicals not naturally found in the wells 240A,B, and 241A, B. Suitable tracers may include radioactive or non-radioactive isotopes. Exemplary tracers include chemicals that can be detected using spectroscopic sensors or other electromagnetic sensors. Additionally, particle size detection using tracers such as silica nanoparticles is also contemplated. The tracers may be oil soluble, water soluble, or gas soluble. Depending upon the natural chemistry of the reservoir and the types of chemicals being introduced for stimulation, remediation, fracturing, etc. the selection of chemicals for the tracer may be different.

Figure 4:
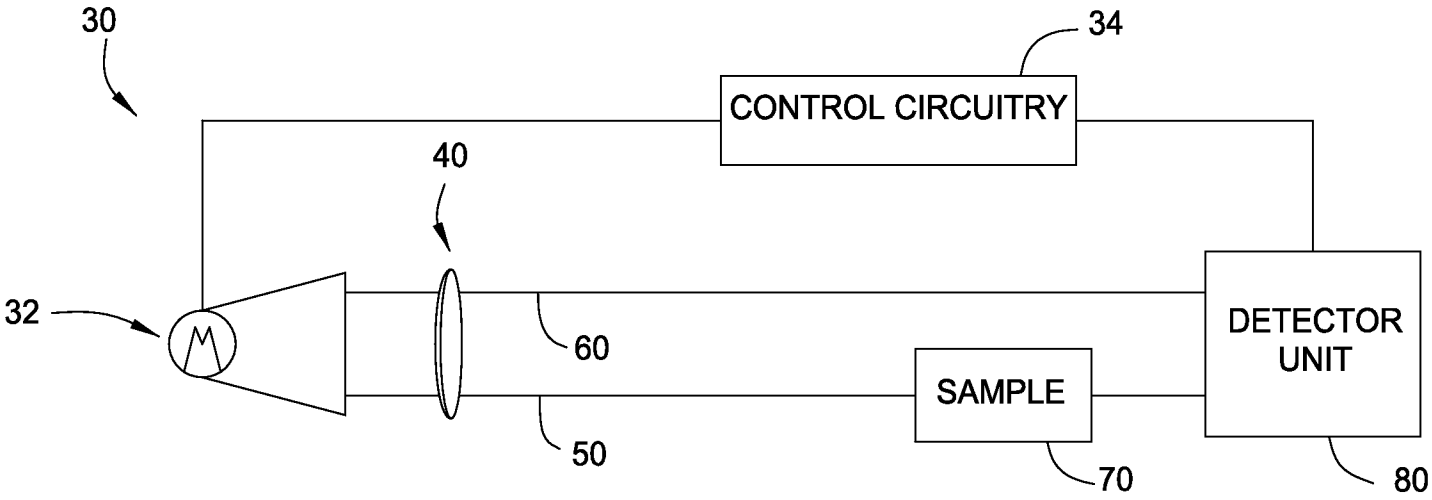
FIG. 4 shows an exemplary embodiment of a tracer sensor suitable for downhole use.

In another embodiment, the tracer sensor may be placed downhole to monitor for tracers within the wellbore such as within a vertical wellbore or within a specific lateral wellbore. An exemplary tracer sensor suitable for a downhole application is disclosed in U.S. Pat. No. 8,436,296 issued to Ford et al, the description of which is incorporated herein by reference. In particular, the Ford patent discloses a downhole tool having a measurement device 30 for downhole fluid analysis, see FIG. 4. Depending on the configuration and types of sources and detectors used and their orientation relative to a sample, the measurement device 30 can operate as a fluorimeter, photometer, reflectometer, or spectrophotometer. For example, the measurement device 30 can operate as a multi-channel photometric analyzer in which discrete wavelengths are interrogated over a given measurement range. In common usage, such a multi-channel photometric analyzer can be referred to as a spectrometer. Thus, the measurement device 30 uses various discrete spectral channels to perform spectroscopic analysis of downhole fluid passing relative to it as the fluid is pumped through the downhole tool. As such, the spectroscopic analysis may include analysis of transmission, absorbance, or fluorescence, and can apply chemometrics, derivative spectroscopy, and other techniques known in the art. Details of how a spectroscope can be implemented in a downhole tool are disclosed in U.S. Pat. No. 7,508,506 issued to Christian et al., which is incorporated herein by reference.

In one embodiment, the measurement device 30 has a source unit 32, source control circuitry 34, a wavelength selection unit 40, a sample assembly 70, and a detector unit 80. The device 30 uses signals from the source unit 32, filters the signals with the wavelength selection unit 40, passes the measurement channel to the fluid sample with the selected wavelength using the sampling assembly 70, and detects the optical signals with the detector unit 80 to determine various characteristics of the sample fluid.

In general, the source control circuitry 34 operates the source unit 32 to generate an input signal with the one or more sources in the source unit 32. In one embodiment, the source unit may include from one to about ten sources; preferably, from two to five sources; more preferably, one to two sources. In general, the source unit 32 provides a narrow band source so that the generated optical signal (EM radiation) from the unit 32 preferably has a narrow wavelength distribution. In general, the source unit 32 can use various types of sources, such as continuous broadband sources or a narrow band source. In one implementation, for example, the source unit 32 can have a broadband source, such as a continuous glow bar, ultraviolet light source, halogen lamps, light emitting diodes (LEDs), short arc Xenon light source, and combinations thereof. An exemplary narrow band source is a laser diode (LD).

The source unit 32 routes the input signal into a measurement channel 50 and a reference channel 60. From the source unit 32, the channels 50 and 60 pass through the wavelength selection unit 40, which selects the wavelength(s) for the channels. Leaving the wavelength selection unit 40, the wavelength selected measurement channel 50 interacts with a sample fluid via the sample unit 70. For its part, the sample unit 70 can use different designs, including, but not limited to, a reflectance accessory, a transmittance accessory, a fluorescence accessory, an Attenuated Total Reflectance (ATR) accessory, or any other sampling or monitoring device known to those skilled in the art.

After interaction with the sample, the measurement channel 50 is detected by the detector unit 80 for analysis. The reference channel 60 is also interrogated by the detector unit 80. The control circuitry 34 can use the detected signals to dynamically scale the measurement channel 50. For example, the control circuitry 34 can dynamically scale the measurement channel 50's signal by the reference channel 60's signal to account for downhole conditions, sensor drift, or the like.

Once the received signals are scaled and decoded, the resulting spectral data can be used to determine chemical and/or physical properties of the sample fluid. This can be performed by the control circuitry 34 used to control the source unit, measure unit, or by some other suitable controller. Ultimately, the measurement device can transmit spectral data to a processing system (not shown) located within the downhole tool or within the surface equipment to detect tracers within the wellbore fluid.

Figure 5:
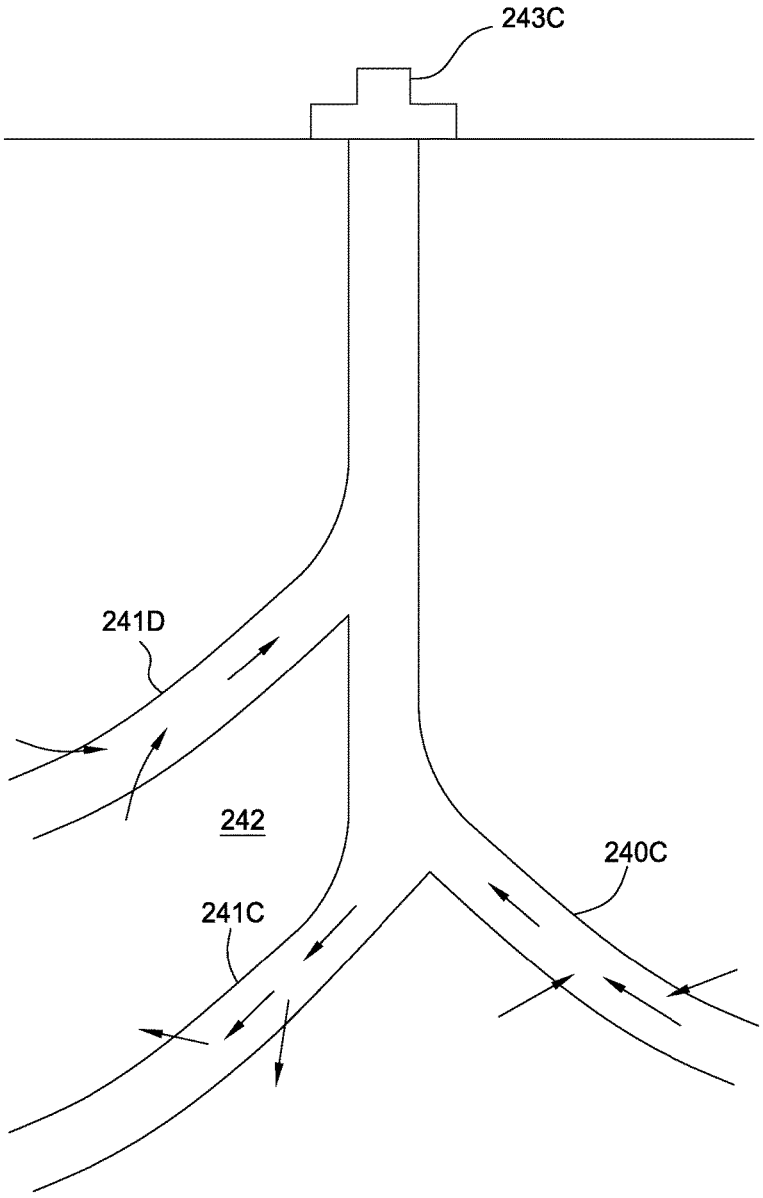
FIG. 5 shows an exemplary embodiment of a fluid injection operation in a multilateral wellbore.

In another embodiment, the tracer sensor may be supplied downhole from one lateral wellbore to monitor for tracers within another lateral wellbore. FIG. 5 illustrates a multilateral wellbore having a wellhead 243C and a first lateral 240C, a second lateral 241C, and third lateral 241D. One or more tracers may be added to the fluid being injected into the reservoir 242 from the first lateral 240C. The tracers injected into the reservoir 242 may flow toward the second and third laterals 241C, 241D. The second and third laterals 241C, 241D may be monitored downhole for the presence of tracers in the respective laterals 241C, 241D. A downhole tracer sensor may be positioned in each of the second and third laterals 241C, 241D for detecting tracers in the respective lateral. Signals may be sent uphole in real time to indicate the detection of the tracers in either or both laterals 241C, 241D.

In one embodiment, an apparatus for monitoring a fluid includes a housing having a bore therethrough; a port in the housing; and a tracer sensor attached to the port, wherein the tracer sensor is configured to monitor the fluid flowing in the bore for the presence of a tracer.

In one or more of the embodiments, the tracer sensor is configured to detect at least two different tracers.

In one or more of the embodiments, the tracer sensor is a modular component that can be exchanged for another tracer sensor.

In one or more of the embodiments, the apparatus includes a vane for directing fluid flow in the housing.

In one or more of the embodiments, a plurality of tracer sensors are attached to the housing.

In one or more of the embodiments, each of the plurality of tracer sensors is attached to a respective port in the housing.

In one or more of the embodiments, the housing includes a thinner profile section.

In one or more of the embodiments, the port is located at the thinner profile section.

In one or more of the embodiments, the thinner profile section has substantially similar cross-sectional area as a regular profile section of the housing.

In one or more of the embodiments, the tracer sensor comprises an optical sensor.

In one or more of the embodiments, the tracer sensor comprises an inductive sensor.

In one or more of the embodiments, the tracer sensor comprises a radioactive tracer sensor.

In one or more of the embodiments, the tracer sensor is threadedly connected to the port.

In another embodiment, a method of monitoring a fluid from a reservoir includes providing a tracer sensor in fluid communication with a first well; injecting a fluid and a tracer from a second well into the reservoir; urging the fluid and the tracer from the reservoir into the first well; and monitoring the fluid in the first well using the tracer sensor to detect the tracer.

In one or more of the embodiments, the first well is a first lateral and the second well is a second lateral of a single multilateral wellbore.

In one or more of the embodiments, monitoring the fluid comprises monitoring the fluid downhole in the first lateral.

In one or more of the embodiments, the tracer sensor is attached to a tubular housing coupled to the wellhead.

In one or more of the embodiments, a signal representing detection of the tracer is sent in real time.

In one or more of the embodiments, the method includes injecting a second tracer from a third well into the reservoir and using the tracer sensor to detect the second tracer in the first well.

In one or more of the embodiments, the tracer is different from the second tracer.

While the foregoing is directed to embodiments of the present invention, other and further embodiments of the invention may be devised without departing from the basic scope thereof, and the scope thereof is determined by the claims that follow.

The invention claimed is:

1. An apparatus for monitoring a fluid, comprising:

a housing having a bore therethrough;

a plurality of ports in the housing; and a plurality of tracer sensors attached to respective ports, wherein the plurality of tracer sensors are configured to monitor the fluid flowing in the bore for the presence of a first tracer and wherein the plurality of tracer sensors are arranged circumferentially about the housing.

2. The apparatus of claim 1, wherein the plurality of tracer sensors are configured to detect at least two different tracers.

3. The apparatus of claim 1, wherein each of the plurality of tracer sensors is a modular component that can be exchanged for another tracer sensor.

4. The apparatus of claim 1, wherein the apparatus includes a vane for directing fluid flow in the housing.

5. The apparatus of claim 1, wherein the housing includes a thinner profile section.

6. The apparatus of claim 5, wherein the port is located at the thinner profile section.

7. The apparatus of claim 5, wherein:

the thinner profile section has substantially similar cross-sectional area as a regular profile section of the housing;

the housing tapers inwards to the thinner profile section;

the thinner profile section has a smaller diameter than a diameter of the regular profile section of the housing.

8. The apparatus of claim 1, wherein one of the plurality of tracer sensors comprises an optical sensor.

9. The apparatus of claim 1, wherein one of the plurality of tracer sensors comprises an inductive sensor.

10. The apparatus of claim 1, wherein one of the plurality of tracer sensors comprises a radioactive tracer sensor.

11. The apparatus of claim 1, wherein each of the plurality of tracer sensors is threadedly connected to the respective port.

12. The apparatus of claim 1, wherein the housing is connected to a flowline leaving a wellhead.

13. A method of monitoring a fluid from a reservoir, comprising:

providing a tracer sensor in fluid communication with a first well, the tracer sensor being configured to monitor fluid flowing through a bore of a tracer detector;

injecting a fluid and a first tracer from a second well into the reservoir;

urging the fluid and the first tracer from the reservoir into the first well; and monitoring the fluid in the first well using the tracer sensor to detect the first tracer.

14. The method of claim 13, wherein the first well is a first lateral and the second well is a second lateral of a single multilateral wellbore.

15. The method of claim 14, wherein monitoring the fluid comprises monitoring the fluid downhole in the first lateral.

16. The method of claim 13, wherein the tracer sensor is attached to a tubular housing coupled to the wellhead.

17. The method of claim 13, further comprising signaling the detection of the tracer in real time.

18. The method of claim 13, further comprising:

injecting a second tracer from a third well into the reservoir; and using the tracer sensor to detect the second tracer in the first well.

19. The method of claim 18, wherein the first tracer is different from the second tracer.

20. The method of claim 13, wherein the reservoir is outside of a wellbore.

* * * * *